United States Patent [19]

Bolding

[11] 4,367,796

[45] Jan. 11, 1983

[54] BLOWOUT PREVENTER AND GUIDELINE HANDLING

[75] Inventor: Vance E. Bolding, Irvine, Calif.

[73] Assignee: Global Marine, Inc., Los Angeles, Calif.

[21] Appl. No.: 208,868

[22] Filed: Nov. 21, 1980

[51] Int. Cl.[3] ..... E21B 19/02; E21B 41/00

[52] U.S. Cl. ..... 166/341; 166/362

[58] Field of Search ..... 166/341, 342, 343, 345, 166/349, 362, 368, 335, 338–340, 352–355; 405/158, 166, 172–174, 177

[56] References Cited

U.S. PATENT DOCUMENTS

| | | | |
|---|---|---|---|
| 3,179,179 | 4/1965 | Kofahl | 166/352 |
| 3,310,108 | 3/1967 | Yancey | 166/341 X |
| 3,368,619 | 2/1968 | Postlewaite | 166/341 |
| 3,477,236 | 11/1969 | Burrus | 166/349 X |
| 3,517,737 | 6/1970 | Petersen | 166/349 X |
| 3,983,708 | 10/1976 | Houot | 166/362 X |
| 4,095,649 | 6/1978 | Chateau et al. | 166/341 X |

*Primary Examiner*—Stephen J. Novosad

*Attorney, Agent, or Firm*—Christie, Parker & Hale

[57] ABSTRACT

Apparatus and method are provided for handling guidelines for an ocean drilling platform rig. A cart for guiding the lines rides on a track and can be moved away from a drill well when a blowout preventer is moved into place over the well on its own cart. When the load of the blowout preventer is transferred to a drilling string, the blowout preventer support cart is moved away from the drill well and the guideline handling cart is positioned over the well. The guidelines are then attached to a guideline frame on the blowout preventer.

13 Claims, 4 Drawing Figures

BLOWOUT PREVENTER AND GUIDELINE HANDLING

BACKGROUND OF THE INVENTION

1. Field of the Invention

This invention pertains to ocean drilling platforms. More particularly, it pertains to a method of handling guidelines running from tensioners located on the drilling platform through a drill well to a submerged wellhead. This invention facilitates guideline handling as a blowout preventer is moved into position over and in the drill well prior to being lowered to the wellhead.

2. Review of the Prior Art

In drilling subsea oil or gas wells in the ocean from a floating structure, there comes a time in the drilling operation when a device known as a blowout preventer (BOP) is lowered to the ocean floor to be connected to the subsea wellhead. A riser pipe, which provides a return path to the drilling platform from the wellhead for flow of drilling mud and the like, or a drill string carrying a special BOP connecter at its lower end, is connected to the upper end of the BOP. The BOP is lowered into position on the wellhead through the agency of the riser or the drill string, as appropriate. As the BOP is lowered toward the wellhead, it is guided along guide cables which are connected to the wellhead structure already in place. After the BOP is installed, these guide cables are maintained in position to guide other equipment moved up and down toward the wellhead.

In the presently preferred embodiment of this invention, an air cushioned drilling platform is employed for oil exploration through the Arctic Ocean or on the tundra. Inasmuch as an air cushion drilling platform is substantially smaller than a conventional floating ocean drilling platform, space is at a premium. If the arrangement used on conventional ocean drilling platforms were used, the BOP could easily get fouled in the upper ends of the guidelines. A need exists for a solution for the problem of handling the guide cables as the blowout preventer is moved into place prior to lowering thereof to the well head through a central drill well of the platform.

The use of this invention in an air cushion drilling platform provides a simple and effective way to facilitate guideline handling which keeps the guidelines out of the way of the blowout preventer as it is moved into place over the drill well on its transfer cart and provides for proper positioning of the guidelines once the BOP is attached to the drilling string. These benefits may also be practiced advantageously on more conventional drilling platforms.

SUMMARY OF THE INVENTION

This invention provides substantial inprovements in guideline handling on ocean drilling platforms. The structural and procedural aspects of the invention are simple, efficient, safe and reliable. The new procedure provides many advantages over conventional guideline handling arrangements and, as noted, prevents fouling of the blowout preventer in the upper ends of the guidelines when the blowout preventer is moved into place over the drill well on its transfer cart, and provides for correct positioning of the guidelines once the blowout preventer is in place over the drill well.

Generally speaking, this invention contemplates a method for handling guidelines extending to a submerged location from a structure located on or above the surface of an ocean. In the course of moving an object to or from the structure from or to the submerged location along a substantially vertical path, the object is guided during the movement by the guidelines.

The method comprises the steps of connecting the guidelines at the structure to a frame which is movable laterally in the structure relative to the path, disposing the frame laterally away from the path so that the guidelines at the structure are laterally displaced from the path, disposing the object in the structure along the path and connecting the object to a mechanism for moving the object along the path, moving the frame into a position aligned with the path thereby to place the guidelines in parallel relation to the path, and movably engaging the guidelines with the object before lowering the object along the path.

In terms of structure, this invention provides an apparatus for handling a flexible guideline extending from a selected location in a structure on or above the surface of an ocean or the like to a submerged location.

The apparatus comprises a guideline frame movably mounted on the structure and from which the guideline extends to the submerged location. Means are provided for moving the frame, between a first position, in which the guideline is disposed at said selected location in the structure, and a second position, in which the frame is displaced laterally from its first position. A tension means connected to the guideline is provided for controlling tension in the guideline between the frame and the submerged location.

BRIEF DESCRIPTION OF THE DRAWINGS

The above-mentioned and other features of this invention are more fully set forth in the following detailed description of presently preferred embodiments of the invention, which description is presented with reference to the accompanying drawings, wherein:

FIG. 1 illustrates guidelines coupled to a guideline pulley frame positioned away from the drill well opening, and a blowout preventer in a storage position to the side of the drill well opening, in preparation for running the BOP stack;

FIG. 2 shows the blowout preventer supported by its cart and positioned over the drill well opening;

FIG. 3 shows the blowout preventer cart returned to its storage position, and the guideline pulley frame positioned over the drill well, the load of the blowout preventer being supported by a riser pipe assembly; and FIG. 4 illustrates the blowout preventer in position on the subsea wellhead and the drilling platform ready for drilling, the guidelines being in position for guiding other objects to the wellhead.

DESCRIPTION OF THE ILLUSTRATED EMBODIMENTS

Figure 1:
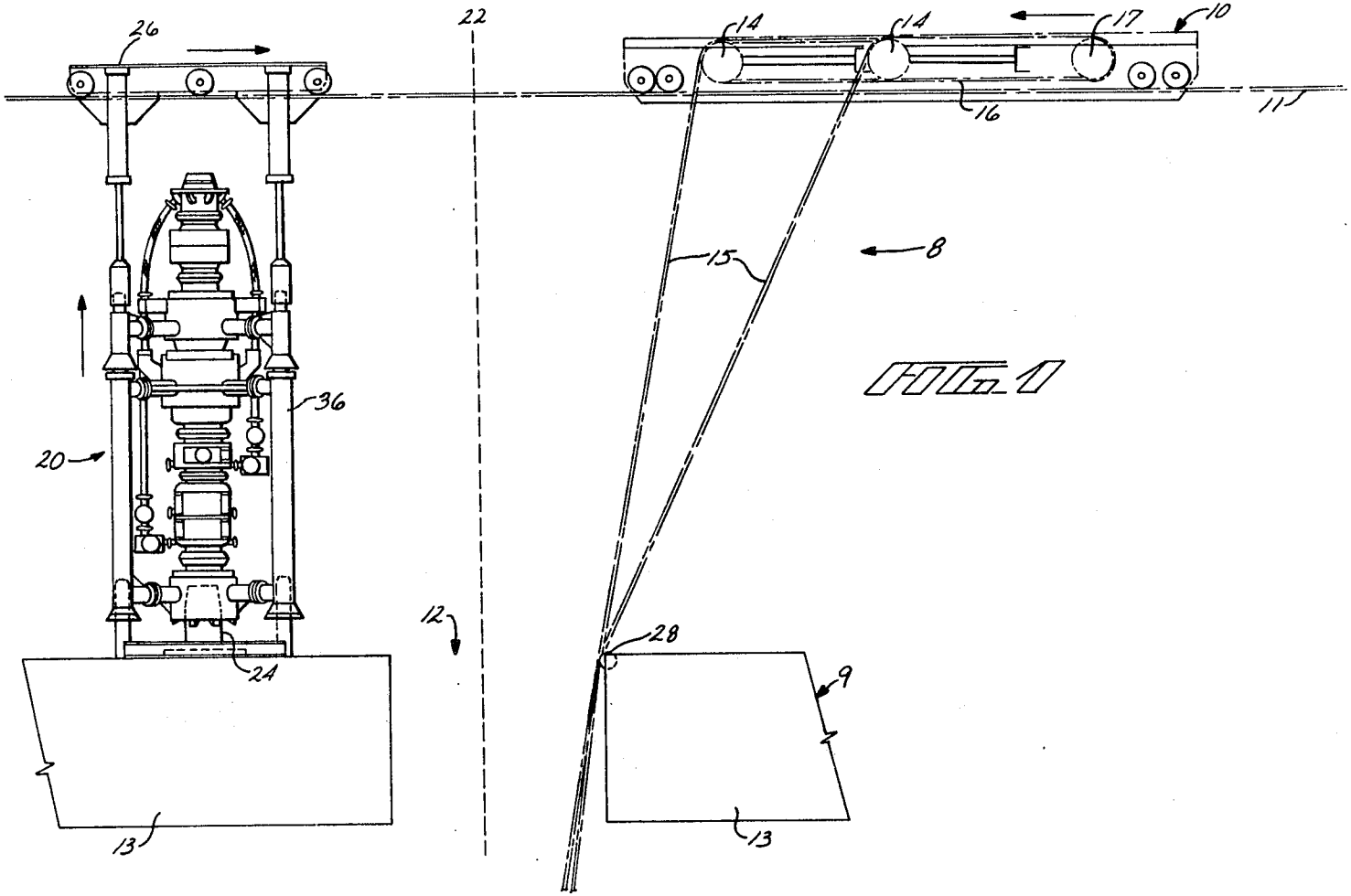
FIGS. 1–4 are side elevation views of a central drill well opening through an air-cushion drilling platform equipped with a guideline handling system according to this invention, and illustrate a step-by-step process of handling the guidelines as a blowout preventer is moved into place over the drill well opening, as follows.

An arrangement 8 for handling flexible guidelines for a subsea drilling platform 9 is illustrated in FIG. 1. A guideline pulley frame 10 is mounted to move along horizontal overhead rails 11 which run above a central drill well 12 defined in the main deck 13 of platform 9.

Preferably, deck 13 is defined by the hull of an air cushion drilling platform. Deck 13, however, may be the hull of a drillship or other offshore drilling platform as this invention may be practiced to advantage on drilling platforms other than air-cushion drilling platforms. Rails 11 preferably are located below the floor of a derrick (not shown) which is supported above deck 13 and on which most drilling operations are performed; the rails may be a part of the substructure of the derrick floor.

The guideline pulley frame includes a series of pulleys 14 for receiving guidelines 15. Pulleys 14 are movable in frame 10 and are coupled to guideline tensioners 16 which are mounted in the frame. The tensioners are operative to establish a desired tension in the guidelines and to maintain such tension as the platform rises and falls in response to wave and tidal action. The guidelines are reeved one or more times over pulleys 14 and over idler pulleys 17 also carried by frame 10. The idler pulleys have axes fixed to the frame, whereas the axes of pulleys 14 are movable in the frame in response to operation of tensioners 16.

Figure 2:
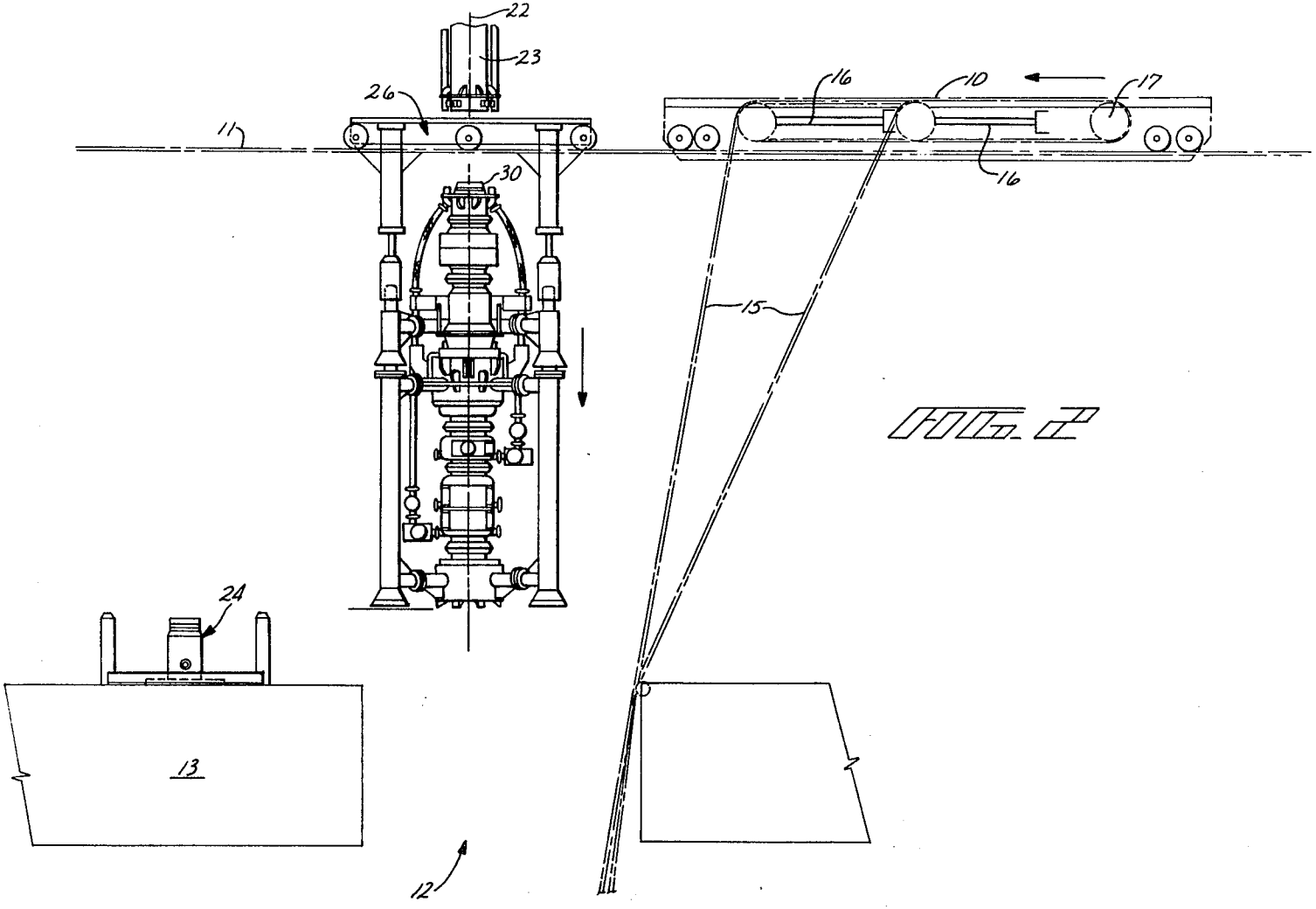
Figure 3:
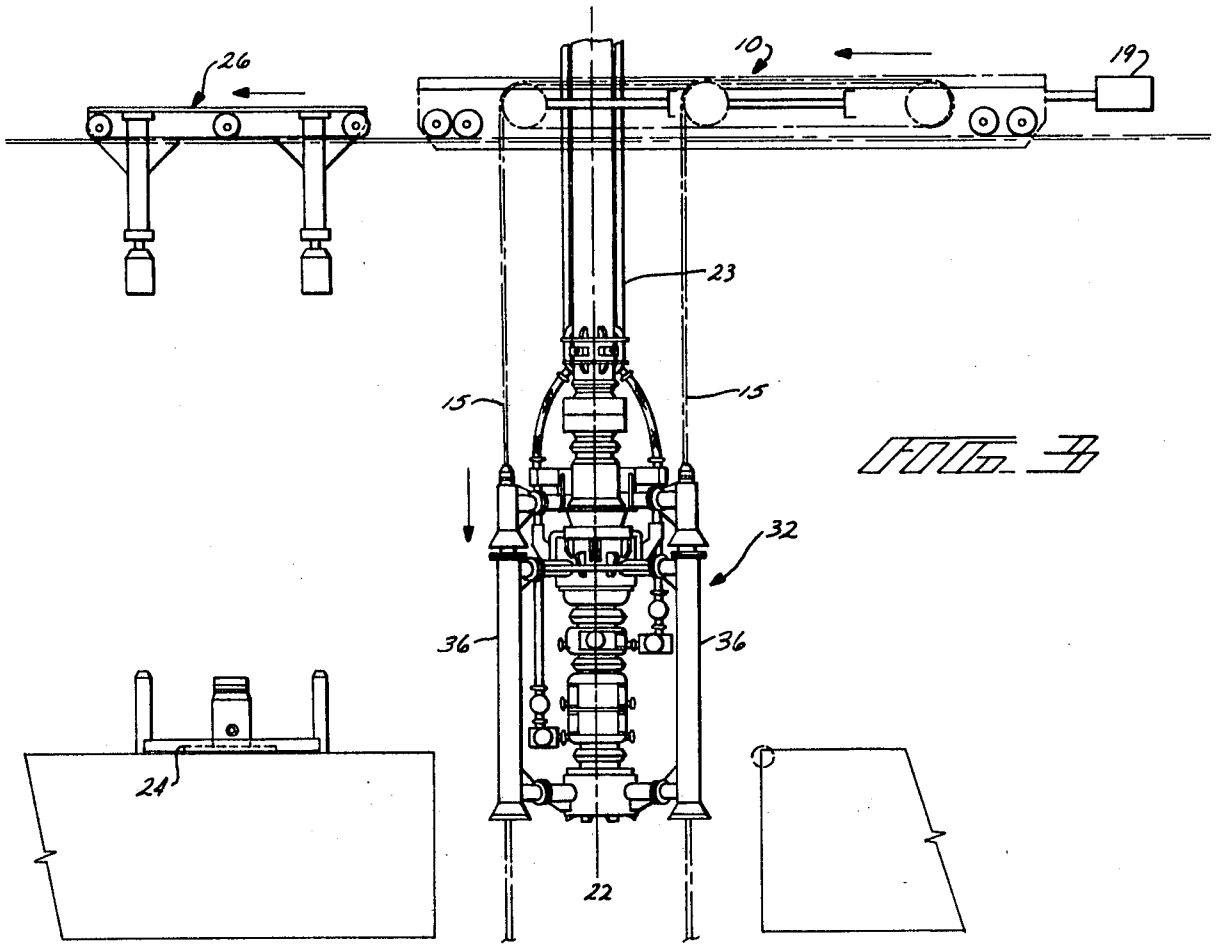
Figure 4:
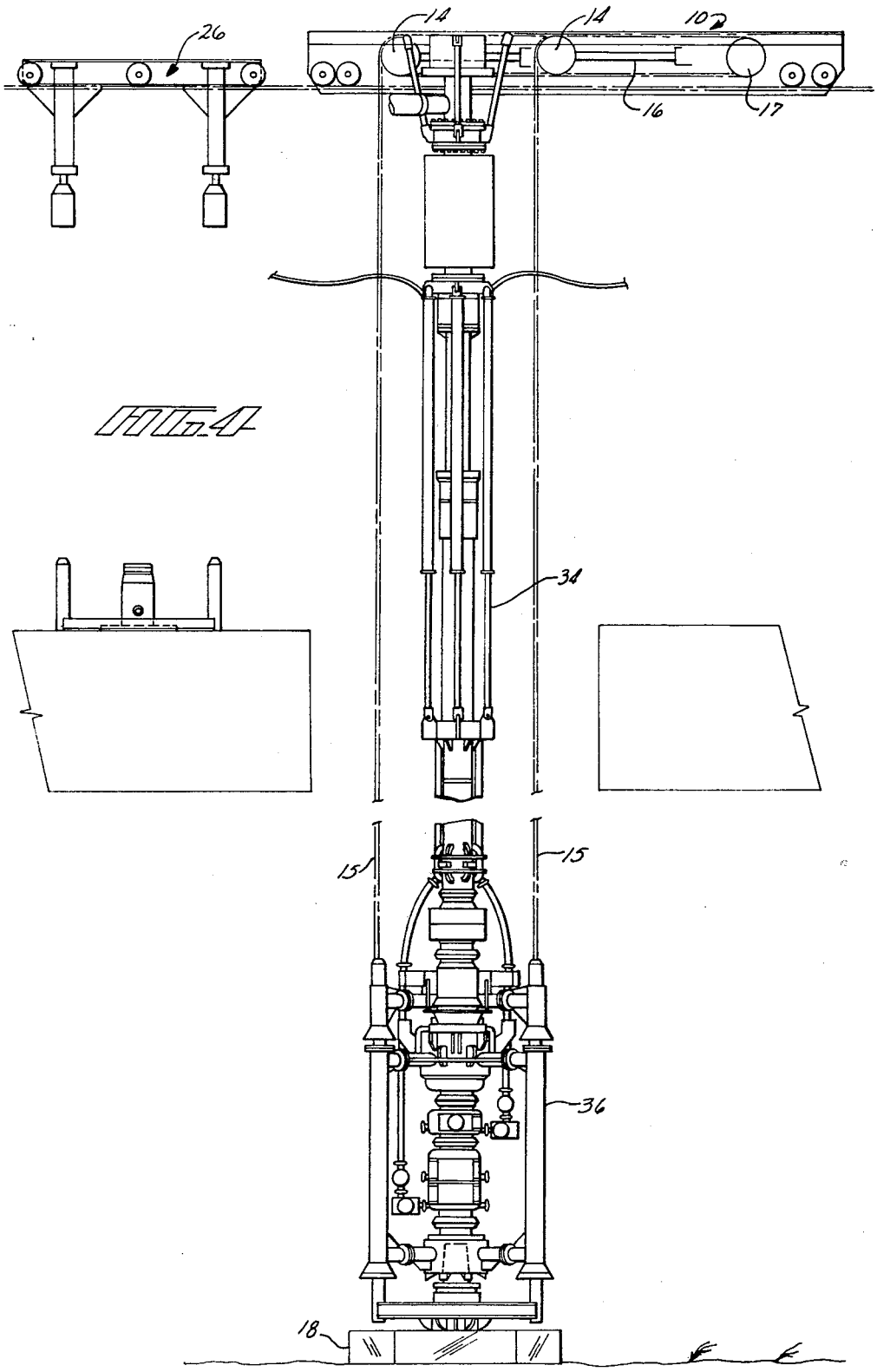

The guidelines pass from pulleys 14 through drill well 12 to a submerged wellhead 18 located on the ocean floor, best seen in FIG. 4. The guidelines provide guidance for objects, such as a blowout preventer 20, to be transferred from the drilling platform to the submerged wellhead. The guidelines are cooperatively received in a set of guide sleeves 36 comprising a guideline frame 32 on the blowout preventer or other object to be transferred. Preferably there are four guidelines, two of which are shown in FIGS. 1–4. The other two guidelines are located behind those guidelines illustrated in FIGS. 1–4. The guidelines act through the agency of sleeves 16 to guide the BOP along a substantially vertical path from or to the platform to or from the wellhead.

The BOP 20 in FIG. 1 is in a position of storage with its weight supported on a BOP test and storage stump 24. A BOP transfer cart 26 is positioned over the stowed blowout preventer. Cart 26 is mounted on the overhead rails 11 and can move along them. Cart 26 is preferably lashed or otherwise secured in position over the stowed BOP, as in FIG. 1, until it is time to run the blowout preventer stack to wellhead 18.

As shown in FIG. 3, frame 10 is coupled to a suitable drive mechanism 19 which is operable to move the frame along rails 11 between a normal deployed frame position, shown in FIG. 3 in which the frame is located over the drill well so that the guidelines pass vertically from pulleys 14 substantially parallel to an axis 22 of a riser pipe assembly 23 through the drill well, and a retracted position, shown in FIG. 1 in which the frame is located laterally away from the axis. Drive mechanism 19 may be a hydraulic mechanism or a mechanical drive such a worm and ball nut assembly. Axis 22 defines a substantially vertical path from the drilling platform to the submerged wellhead. The BOP is transferred along the path. Thus the guidelines are connected at the drilling structure to a frame which is movable laterally relative to the path along axis 22.

When the drilling operation has reached the stage where it is necessary to run the BOP stack to the wellhead, the guidelines 15 are slacked somewhat but not fully, and the guideline pulley frame 10 is moved from its storage position over the drill well, shown in FIG. 3, to a position laterally alongside the drill well opposite from cart 26; see FIG. 1. When the guideline pulley cart has been disposed laterally away from the path along axis 22, as shown in FIG. 1 and FIG. 2, the guidelines are laterally displaced from the path and are preferably received in pulleys 28 or on rollers mounted alongside the drill well.

The load of the BOP is transferred from test and storage stump 24 to BOP transfer cart 26. The latches on cart 26 are released and the cart is moved along overhead rails 11 from the storage position shown in FIG. 1 to a position over the drill well 12 and along the path defined by drill axis 22, shown in FIG. 2. The BOP cart is latched into position over the drill well.

A drilling riser pipe assembly 23 (or a drilling string, if desired) is lowered from the drilling rig floor above the overhead rails through the BOP transfer cart to engage a coupler 30 at the top of the BOP. The load of the BOP is transferred to the riser pipe from the BOP transfer cart. The connection to the riser pipe supports the BOP and provides a means to lower or raise the BOP along substantially vertical path 22. The riser pipe and the BOP are lowered several inches to release the blowout preventer from the transfer cart. The latches on the transfer cart are released and the cart is moved back along the overhead rails to its original storage position over storage stump 24 as shown in FIG. 3.

The latches on the guideline pulley frame are released and the frame is moved along the overhead rails into position aligned with axis 22 over the central drill well. This places the guidelines in parallel relation to the path. Preferably this is the position the guideline tensioner frame occupied when the guidelines were strung from the guideline pulley frame to the subsea wellhead. The guidelines 15 are rigged through guideline sleeves 36 which then slidably engage the guidelines. The guideline pulley frame is latched or otherwise suitably secured into position along the path.

The riser pipe assembly 23 is lowered along axis 22 to lower the BOP into position along guidelines 15 to subsea wellhead 18. Guideline pulley frame 10 preferably is retained in position over the drill well after the BOP has been mated to wellhead 18 so that other objects may be transferred and guided along the guidelines to the wellhead or vice versa as necessary during further drilling operations.

The guideline handling method described above enables safe, efficient and speedy handling of the guidelines as the BOP is disposed along path 22 and rigged for lowering along the path to the submerged wellhead. By reeving the guidelines over pulleys carried by the movable pulley frame, the guidelines may be shifted laterally above the center well to enable the BOP to be moved into position prior to lowering into the submerged wellhead, all without disconnecting the guidelines from their tensioner mechanisms.

The preferred guideline pulley frame 10 is U-shaped which enables movement along rails from a retracted position shown in FIG. 1 to a deployed customary position over the drill well illustrated in FIG. 3 in the presence of a drill string or riser pipe between the rails. In the preferred method of handling guidelines, guideline tensioners are located in movable frame 10. However, the guideline tensioners may be mounted elsewhere on the platform with the guidelines run therefrom over the guide pulleys 14 carried by the frame, and this invention may be so practiced.

Persons skilled in the art to which this invention pertains will appreciate that the preceding description has been presented with reference to the presently preferred embodiment of the invention illustrated in the accompanying drawings. It will be understood, however, that the present invention can be manifested in structural and procedural embodiments different from that described. The preceding description sets forth the presently known best mode of practicing the invention, but certainly not all possible modes. Accordingly, workers skilled in the art will readily appreciate that modifications, alterations of or variations in the arrangements and procedures described above may be practiced without departing from, and while still relying upon, essential aspects of this invention.

What is claimed is:

1. Apparatus for handling a flexible guideline extending from a selected location in a structure on or above the surface of an ocean or the like to a submerged location, the apparatus comprising:

a guideline frame mounted for lateral movement in the structure and from which the guideline extends to the submerged location;

means for moving the frame laterally in the structure between a first position and a second position, the frame at the first position being disposed at said selected location in the structure, the frame at the second position being displaced laterally from its first position; and tension means connected to the guideline for controlling tension in the guideline between the frame and the submerged location

2. Apparatus according to claim 1 wherein the structure defines an opening therethrough through which the guideline extends between said selected location and the submerged location, and the selected location is above the opening.

3. Apparatus according to claim 2 wherein an object is to be transferred from the structure to a submerged location along the guideline, and the object is to be positioned over the opening before engaging the guideline, the apparatus further comprising:

an object frame movably mounted on the structure for supporting the object;

means for moving the object frame from a third position laterally disposed from the opening to a fourth position over the opening; and means for lowering the object from the object frame through the opening.

4. Apparatus according to claim 3 in which the fourth position substantially coincides with the first position.

5. Apparatus according to claim 3 in which the object frame is mounted on a rail for movement between the third and the fourth positions.

6. Apparatus according to claim 3 wherein the guideline frame and the object frame are mounted on a common rail for lateral movement between the positions.

7. Apparatus according to claim 1 wherein the tension means is carried by the frame.

8. Apparatus according to claim 1 wherein the guideline frame is mounted on a rail for movement between the first and the second positions.

9. A method for handling guidelines extending to a submerged location from a structure located on or above the surface of an ocean in the course of moving an object to or from the structure from or to the submerged location along a substantially vertical path during which movement the object is guided by the guidelines, the method comprising the steps of:

connecting the guidelines at the structure to a frame which is movable in the structure laterally relative to the path;

disposing the frame laterally away from the path so that the guidelines at the structure are laterally displaced from the path;

disposing the object in the structure along the path and connecting the object to a movably operable means for moving the object along the path;

moving the frame into a position aligned with the path thereby to place the guidelines in parallel relation to the path; and movably engaging the guidelines with the object before lowering the object along the path.

10. A method according to claim 9 wherein the frame is mounted on a track in the structure, and the step of disposing the object in the structure along the path further comprises the step of moving the object along the track into alignment with the path.

11. A method according to claim 10 in which an object support cart is movably mounted on the track for transporting the object in the structure from a first position laterally away from the path to a second position along the path, the method further comprising the step of moving the object support cart from the first position to its second position after the step of disposing the frame laterally away from the path and, after the step of connecting the object to the movably operable means, further comprising the step of moving the object support cart laterally away from the path to enable the frame to move into a position aligned with the path.

12. A method for handling flexible guidelines connecting a structure located on or near the surface of an ocean to a submerged location in the course of moving an object between the structure and the submerged location along a substantially vertical path of movement during which movement of the object is guided by the guidelines, the method comprising the steps of:

extending the flexible guidelines to the submerged location from a movable frame disposed in the structure away from the path;

positioning the object along the path;

moving the frame sufficiently in the structure to place the guidelines in parallel relation to the path; and engaging the flexible guidelines with the object to guide it along the path.

13. In an ocean drilling platform in which a drilling string is suspended from a drilling platform on a structure located on or above the surface of an ocean through an opening in the structure to a submerged well head, and in which a blowout preventer stored on the structure is to be lowered along guidelines extending parallel to a vertical line of movement through the opening to the submerged wellhead, and in which the blowout preventer is supported by a first cart movably mounted on a track on the platform for selective movement between a first position away from the vertical line and a second position aligned with such line for coupling of the blowout preventer, prior to lowering thereof along the vertical line, to a plurality of guidelines coupled to guideline tensioners located on the structure, the guidelines extending from the structure to the submerged wellhead, the improvement comprising:

a second cart movably mounted on the track for receiving the guidelines, the second cart being selectively movable between a first position thereof away from the vertical line of movement and a second position thereof aligned with said vertical line.

* * * * *